US010506888B2

(12) United States Patent
McMahon et al.

(10) Patent No.: US 10,506,888 B2
(45) Date of Patent: Dec. 17, 2019

(54) FRAME WITH INTERCHANGEABLE PANELS

(71) Applicant: Bay Island, LLC, Minnetonka, MN (US)

(72) Inventors: Kenneth D. McMahon, Edina, MN (US); Jeffrey Louwagie, Minnetonka, MN (US)

(73) Assignee: Bay Island, LLC, Minnetonka, MN (US)

( * ) Notice: Subject to any disclaimer, the term of this patent is extended or adjusted under 35 U.S.C. 154(b) by 0 days.

(21) Appl. No.: 16/210,712

(22) Filed: Dec. 5, 2018

(65) Prior Publication Data

US 2019/0167017 A1 Jun. 6, 2019

Related U.S. Application Data

(60) Provisional application No. 62/595,191, filed on Dec. 6, 2017.

(51) Int. Cl.

| | |
|---|---|
| ***A47G 1/06*** | (2006.01) |
| ***A47G 1/08*** | (2006.01) |
| ***A47G 1/12*** | (2006.01) |
| ***G09F 1/12*** | (2006.01) |
| ***G09F 15/00*** | (2006.01) |

(52) U.S. Cl.

CPC ..... *A47G 1/065* (2013.01); *A47G 1/0605* (2013.01); *A47G 1/08* (2013.01); *A47G 1/12* (2013.01); *G09F 1/12* (2013.01); *G09F 15/0012* (2013.01); *G09F 15/0018* (2013.01); *A47G 2001/0661* (2013.01); *A47G 2001/0677* (2013.01)

(58) Field of Classification Search

CPC .. A47G 1/065; A47G 1/12; A47G 1/08; G09F 1/12

See application file for complete search history.

(56) References Cited

U.S. PATENT DOCUMENTS 1,742,378 A * 1/1930 Boese ..... A47G 1/06 40/738
1,743,190 A * 1/1930 Champlain, Jr. ..... A47G 1/142 40/745

(Continued)

FOREIGN PATENT DOCUMENTS

CN 202604297 A1 12/2012
CN 207041362 U * 2/2018

(Continued)

OTHER PUBLICATIONS

Art Vinyl Play and Display Record Frame, Nov. 20, 2017, Evanston, Illinois United States.

*Primary Examiner* — Cassandra Davis
(74) *Attorney, Agent, or Firm* — Nicholas S. Kuhlmann

(57) ABSTRACT

A frame for the interchangeable and selective display of panels of artwork or text, where at least one interior surface of the frame defines a cavity in which one or more panels may be disposed, and channels are formed on the interior surface to receive a rod that slidably engages the channels to secure and accessibly store one or more panels within the frame. Also disclosed is a technique for disposing one or more panels within a frame for display and securing the one or more panels by advancing a rod along channels to exert force against the one or more panels.

20 Claims, 7 Drawing Sheets

(56) References Cited

U.S. PATENT DOCUMENTS

| | | | | | |
|---|---|---|---|---|---|
| 2,242,148 | A * | 5/1941 | Sanders | A47G 1/06 | 40/768 |
| 4,270,288 | A * | 6/1981 | Sulzer | G09F 1/12 | 40/661 |
| 4,726,133 | A * | 2/1988 | Rainone | A47G 1/0644 | 40/721 |
| 5,199,201 | A | 4/1993 | Vilims | | |
| 5,289,651 | A | 3/1994 | Byers | | |
| 6,053,585 | A | 4/2000 | Osen | | |
| 6,293,038 | B1 | 9/2001 | Chang | | |
| D451,290 | S | 12/2001 | Allen | | |
| 6,553,704 | B1 | 4/2003 | Pigg | | |
| 6,868,630 | B2 | 3/2005 | Kim | | |
| 7,984,578 | B2 | 7/2011 | Kabel | | |
| 8,875,430 | B2 | 11/2014 | Leboff | | |
| 9,770,124 | B2 | 9/2017 | Singer | | |
| 2004/0134111 | A1 | 7/2004 | Berg | | |
| 2007/0181771 | A1 | 8/2007 | Alcov | | |
| 2008/0000125 | A1 | 1/2008 | Chang | | |
| 2009/0119965 | A1 | 5/2009 | Broehl | | |
| 2014/0259840 | A1 | 9/2014 | Placko | | |

FOREIGN PATENT DOCUMENTS

| | | | | |
|---|---|---|---|---|
| GB | 2369051 A * | 5/2002 | A47G 1/06 | |
| WO | 2016090114 A1 | 6/2016 | | |

* cited by examiner

FRAME WITH INTERCHANGEABLE PANELS

CROSS-REFERENCE TO RELATED APPLICATION

This non-provisional U.S. patent application claims priority to and the benefit of the filing date of a provisional application, U.S. Provisional Application No. 62/595,191, filed on Dec. 6, 2017. The disclosure of U.S. Provisional Application No. 62/595,191 in its entirety is expressly incorporated herein.

TECHNICAL FIELD

The present disclosure relates to a frame for storing and displaying one or more panels, such as interchangeable panels including decorative art, sayings, or written notices.

BACKGROUND

Traditional frames are often configured to display only one piece of art, or may not be configured to store multiple pieces of art. The interior of such frames often is not easily accessible, and pieces of art may not be easily interchanged. Such frames also may not include a mechanism to secure varying numbers of pieces of art within the frame.

SUMMARY

The present disclosure describes a frame including a body that includes at least one interior surface that defines a cavity, where a first channel is disposed on a first portion of the interior surface and a second channel is disposed on a second portion of the interior surface, the first channel is configured to receive a first end of a rod and the second channel is configured to receive a second end of the rod, such that the rod extends between and slidably engages the first and second channels, and where the cavity is configured to receive at least one panel that may display images, such as artwork, poems, written notices, or other text on one or both sides of the panel. The body further includes a front border that defines a window through which an image disposed on a panel may be displayed, where the front border includes an interior lip that protrudes inwardly toward the center of the frame from the at least one interior surface of the body. The rod may be configured to secure the at least one panel against an interior lip of the front border within the body of the frame.

In some example frames, the body may include a front side and a back side, where the at least one exterior surface extends from the front side to the back side of the body, and where each of the first channel and second channel includes a front end and a back end, such that the front end of each of the first and second channels is more proximate to the front side of the body than the back end of each of the first and second channels.

Further, in this example, the cavity may be configured to receive at least one panel comprising a front side and a back side. The body also may include a front border disposed on the front side of the body, where the front border defines a window, and the front border includes an interior lip.

An example frame of this disclosure also may include a rod that extends from the first channel to the second channel, where the rod includes a first end that slidably engages the first channel and a second end that slidably engages the second channel, such that when advanced along the first and second channels toward the front side of the body, the rod engages and exerts a force against the back side of the at least one panel and the interior lip of the front border engages and exerts a force against the front side of the panel to secure the panel within the body of the frame.

This disclosure also describes a frame system that includes a body with at least one interior surface that defines a cavity and a front border that includes an interior lip, where a first channel is disposed on a first portion of the interior surface and a second channel is disposed on a second portion of the interior surface, the interior lip protrudes inwardly toward the center of the frame from the at least one interior surface, and the front border defines a window. The described frame system also may include a rod that extends from the first channel to the second channel and slidably engages the first and second channels, such that the rod is configured to secure one or more panels against the interior lip of the front border within the body of the frame. The described frame system also may include at least one panel, or multiple panels, disposed within the cavity of the frame. The panels may be reversible such that a different image is displayed on each side of the panel, for example artwork, text, or holiday themes.

The present disclosure also describes a technique including the steps of disposing a panel within a cavity defined by at least one interior surface of a body of a frame, where a first channel is disposed on a first portion of the at least one interior surface and a second channel is disposed on a second portion of the at least one interior surface of the body, a front end of each of the first and second channels is more proximate to a front side of the body than a back end of each of the first and second channels, and the body includes a front border that defines a window through which a front side of the panel, and an image disposed thereon, may be viewed. The front border also includes an interior lip that protrudes inwardly toward the center of the frame from the at least one interior surface. The disclosed technique also utilizes a rod that extends from the referenced first channel to the second channel, such that a first end of the rod is disposed in and slidably engages the first channel and a second end of the rod is disposed in and slidably engages the second channel.

The described technique includes the further step of securing the panel within the frame, where securing the panel includes disposing the rod in the first and second channels and advancing the rod toward the respective front ends of the first and second channels until the rod engages a back side of the panel and exerts a force against the back side of the panel and an interior lip of the front border of the body of the frame exerts an opposing force against the front side of the panel to secure the panel within the frame.

The details of one or more examples are set forth in the accompanying drawings and the description below. Other features, objects, and advantages will be apparent from the description and drawings, and from the claims.

DETAILED DESCRIPTION

The present disclosure describes a frame that permits the storage and display of one or more interchangeable panels within a frame in an efficient, durable, and easily accessible manner. Panels as described may include images with artwork, photographs, characters, poems, written notices, or other text. In some examples, the panels include different such images on both a front side and a back side thereof. One or more panels may be secured by a rod that slides in channels within one or more interior surfaces of the frame. Different numbers of panels may selectively be stored and secured, as the rod is adjustable along the channels to secure them within the frame at nearly any point along the length of the channels.

The present disclosure allows for centralized storage, easy accessibility and interchangeable display of multiple panels, with multiple images thereon, without the need to pivot numerous tabs, remove many layers of backing, or move items between sleeves or containers.

Figure 1:
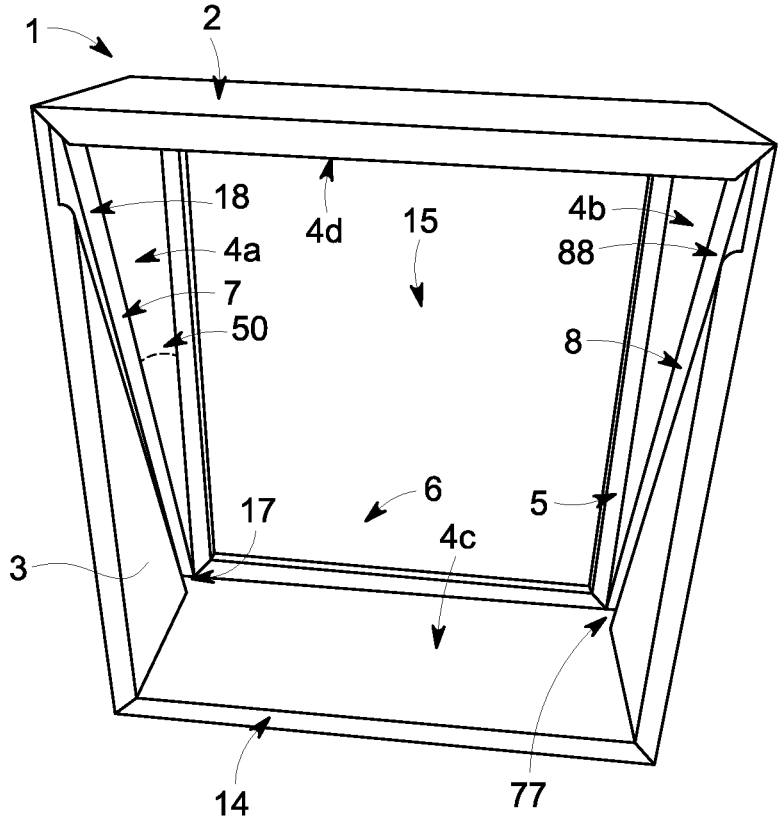
FIG. 1 is a slightly elevated perspective view from the back side of an example frame showing first and second channels disposed on interior surfaces of a body of the frame.

The disclosed frame may take any number of shapes, including without limitation square, rectangular, polygonal, curvilinear, circular, oblong, or a combination thereof. Likewise, the shape of an interior surface of the body, on which channels are disposed, may be curvilinear, circular, oblong (or portions thereof), or combinations thereof, in some examples. In other examples, there may be multiple interior surfaces of the body of the frame, such as first, second, third, and fourth portions or sides of a square or rectangular interior surface configuration (as shown in FIG. 1), or any number of sides in a polygonal configuration.

The positioning of a securing rod behind the one or more panels that may be disposed within the frame depends on the shape of the frame. In some examples, the rod may extend across an entire width or height, or nearly the entire width or height, of the frame. In other examples, the rod may contact only a portion of the back side of a panel, yet still supply sufficient force to secure the panel in place.

Figure 4:
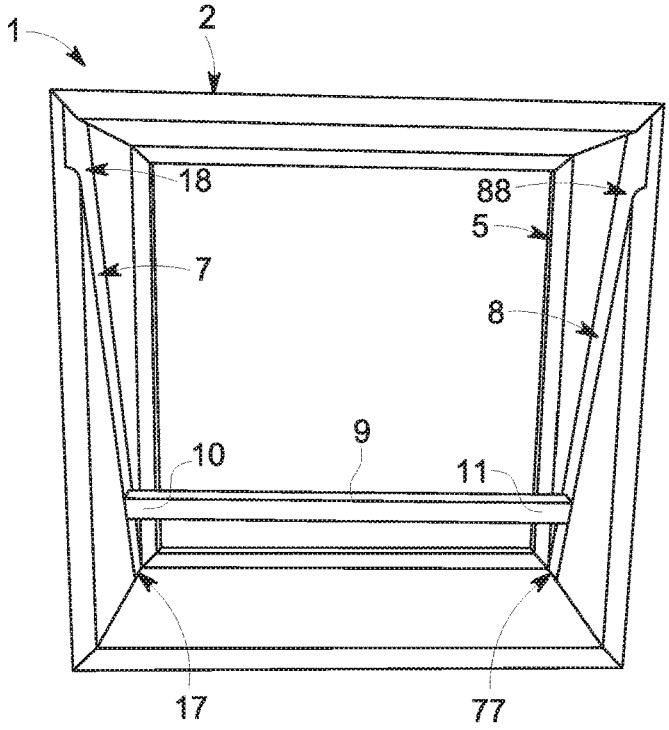
FIG. 4 is a perspective view from the back side of an example frame that shows an interior lip of the body that protrudes inwardly at the front side of the example frame, among other features.

Providing a force to the front side of the one or more panels to secure them in an example frame is an interior lip that is part of the front border of the body of the frame. The front border including the interior lip may be constructed in any number of configurations, and be of either integral construction with the body of the frame, or a separate component attached thereto. In some examples, the interior lip protrudes inwardly from the at least one interior surface of the frame at or near the front side of the frame, protruding toward the center of the frame (for example, toward the center of the frame within the plane in which the front border is disposed) such that the interior lip creates a distinct perimeter of a window, for example as shown at FIG. 4. The area encompassed by the window is thus generally smaller in size than the area encompassed by an exterior surface of the frame or the exterior of the frame border. Likewise, a portion of the frame border protrudes inwardly toward the center of the frame, as the frame border is generally the opposite side from the interior lip, as described herein. In other examples, the interior lip may protrude from only a portion or portions of the interior surface at or near the front side of the frame (e.g., one or more interior lips that protrude in a plane parallel to the front border toward a center of the frame and shaped as triangles at opposing diagonal corners of a frame, lips that border only a top and bottom side of the body of the frame, or lips that border only each side of the frame), in a manner that permits force to be applied to the front side of a panel when secured from behind by a rod disposed within first and second channels as described herein.

First and second channels are disposed on first and second portions (e.g., sides) of an interior surface of the body of the frame (e.g., on opposing sides of a square-shaped interior surface) in positions that permit a rod to secure panels from the back side of the panels, such as horizontally across the back side of a panel, vertically across the back side of a panel, diagonally or at any sufficient angle across a portion of a panel.

FIG. 1 shows a slightly elevated perspective view from the back side of an example frame [1] showing first and second channels disposed on at least one interior surface [3] of a body [2] of the frame. In this example, body [2] includes a plurality of interior surfaces, namely, a first interior surface [4*a*] positioned parallel to and opposing a second interior surface [4*b*], and a third interior surface [4*c*] positioned parallel to and opposing a fourth interior surface [4*d*]. Interior surfaces assembled in the manner disclosed at FIG. 1 define a cavity [6] within a square-shaped frame.

In this example, opposing edges of third interior surface [4*c*] engage with a respective edge of each of the first and second interior surfaces [4*a* and 4*b*], while the third interior surface extends between the first and second interior surfaces. Opposing edges of fourth interior surface 4*d* also engage with the opposing respective edges of the first and second interior surface as shown in the example frame of FIG. 1, while the fourth interior surface extends between the first and second interior surfaces, such that the plurality of interior surfaces form a square-shaped cavity [6].

In some examples, edges of the sides of frame [2] that engage to form cavity [6] may be tapered so that they may be more easily mated. The ends or edges of the respective interior surfaces may be joined using any suitable technique, such as one of or a combination of, for example, a miter joint, butt joint, nail, glue or metal fasteners. Each interior surface has a corresponding exterior surface that forms a portion of the exterior of body [2]. As noted, in some examples, portions or all of body [2] of frame [1] may be casted or molded as an integral and continuous object from any suitable material, as described herein.

As shown in FIG. 1, a first channel [7] is disposed on first interior surface [4*a*], while a second channel [8] is disposed on second interior surface [4*b*] of the body [2] of frame [1]. In this example, the channels are substantially parallel (or parallel) to one another and oriented at an angle [50] of approximately 15° to 20° measured from a vertical plane co-planar with interior lip [5] or from a vertical plane formed by the front side [13] of body [2] of frame [1].

Body [2] further includes a front side [13] (see FIG. 7) and back side [14]. A front border [16] (also see FIG. 7) defines a window [15] through which a front side [19] of a panel [12] may be viewed when disposed within the cavity [6] within the frame [1]. As noted, in some examples, a body of a frame may include at least one interior surface [3] that extends from the front side [13] to the back side [14] of the body [2] and defines the cavity [6] within the frame that receives one or more panels [12]. For example, a single interior surface [3] may be curvilinear, round, or oblong, with channels disposed therein. In the example frame of FIG. 1, as noted, the ends of interior surfaces [4*a*, 4*b*, 4*c*, and 4*d*] are connected and form a square.

In some examples, front side [13] of body [2] forms a square in its longitudinal cross-section, is substantially square, or rectangular. In other examples, front side [13] may be virtually any other shape in its longitudinal cross-section, such as polygonal, curvilinear, circular, oblong, or a combination thereof. In some cases, the corners of body [2] may have rounded edges. Further, in some examples, one or more (or all) components of body [2] may be integrally connected, such as from a single casting of material (such as plastic, metal, or the like as described herein), rendered from an integral piece of wood, or integrally molded fiber board, or the like. Further, in some examples, body [2] may have rounded edges. In another example the frame body [1] has rounded edges.

As shown in FIG. 1, a first channel [7] is formed in and disposed along a first interior surface [4*a*] of the body [2]. The first channel [7] is of a depth that is sufficient to retain an end of the rod, yet does not fully extend through the side of the frame. A second channel [8] is disposed on the second interior surface [4*b*] of the body. In some examples, one or both of the channels may extend entirely through the side of the body, and receive respective ends of the rod therein.

Figure 2A:
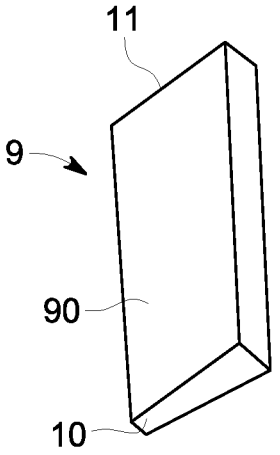
FIG. 2A is a perspective view of an example rod with a polygonal transverse cross-section, as described herein as part of a frame or frame system.

In the example frame [1] of the present disclosure at FIG. 1, the first channel [7] and second channel [8] are aligned and configured to receive respective opposing ends of a rod therein. As shown in FIG. 2A, a rod may form a polygon in its traverse cross-section, with a substantially constant shape throughout its length. For example, the rod may be substantially rectangular, square, trapezoidal, curvilinear in its transverse cross-section, or have one tapered side as shown in FIG. 2A. In some examples, corners of a polygonal rod may be rounded, or certain sides may be linear while others curved or curvilinear. As further shown in another example rod of FIG. 2B, rod also may be a cylinder of approximately the same diameter throughout its length. A rod that is substantially rectangular in its transverse cross-section with one tapered side may provide more area of contact between the tapered side of the rod and the back of the panel when secured within the frame than a rectangular rod. In this example, the tapered side of the rod faces forward toward the front of the frame when the rod is inserted in and advanced along the first and second channels. A substantially rectangular rod also assists in securing the rod in place in the channels by the forces of friction between the sides of the rod that engage the sides of the respective channels.

In other examples, the rod may have other shapes or thicknesses along its length, as described further herein. The rod [9] fits into the channels [7, 8] and can slide along the track defined by the channels. Rod [9] includes a first end [10] and a second end [11]. The first end of the rod [10] may slidably engage first channel [7], while second end [11] of the rod may slidably engage second channel [8].

Each of first channel [7] and second channel [8] includes a front end and a back end, where the front end of each of the first and second channels is more proximate to the front side of body [13] than the back end of each of the first and second channels, and the back end of each of the first and second channels or more proximate the back side [14] of body [2]. For example, first channel [7] has a front end [17] and a back end [18], and second channel [8] has a front end [77] and a back end [88], as shown in FIG. 1.

As noted, in the example of FIG. 1, when measured from the vertical plane formed at the front border of the frame, the first and second channels are oriented at an identical or nearly identical angle [50] of between 1° and 89°, such as approximately a 15° to 20° angle as shown in FIG. 1. The more angle [50] of the channels approaches 90° in such an example, the retention of the rod and securing of the panels becomes more reliant on gravity acting on the rod in the channels. In some cases, a more dense or heavy material for construction of the rod may be used to aid in securing of the panels in this manner. In other examples, the channels may be oriented between 91° and 179° as measured from a plane co-planar with interior lip [5] of body [2]. In these latter examples, retention of the rod in the channels and securing of the panels may become more reliant on friction than channels oriented in the former manner.

In some examples, first and second channels [7, 8] that receive rod [9] may be curved or curvilinear. In general, channels in at least one interior surface of a frame may be machined in to the one or more interior surface, or created by fastening additional structures made from any suitable material to the one or more interior surface that include the channels. In some cases, there may be multiple sets of channels and rods that secure a single panel within the cavity of a frame.

In the example frame of FIG. 1, the first channel [8] and second channel [9] are configured to receive a rod as described herein, and further formed such that they have substantially straight and flat surfaces and that the angle formed between the base of the channel and each of the respective sides of the channel is 90° or nearly 90°. In such an example the first and second end of the rod [10, 11] as shown in FIG. 2 may be in substantially continuous contact with the interior surfaces of the channel. In another example the first and second channels [7, 8] may have a rounded interior surface. In such an example a rod with rounded ends may be used such that the ends of the rod may be in substantially continuous contact with the interior surfaces of the channel.

In the example frame of FIG. 1, the first and second channels [7, 8] may be formed by machining the channels into the first and second interior surfaces [4*a*, 4*b*] respectively. In other examples, the first and second channels may be formed by disposing additional structures that include respective channels on to the first and second interior surfaces [4*a*, 4*b*], respectively, to form the channels.

Figure 7:
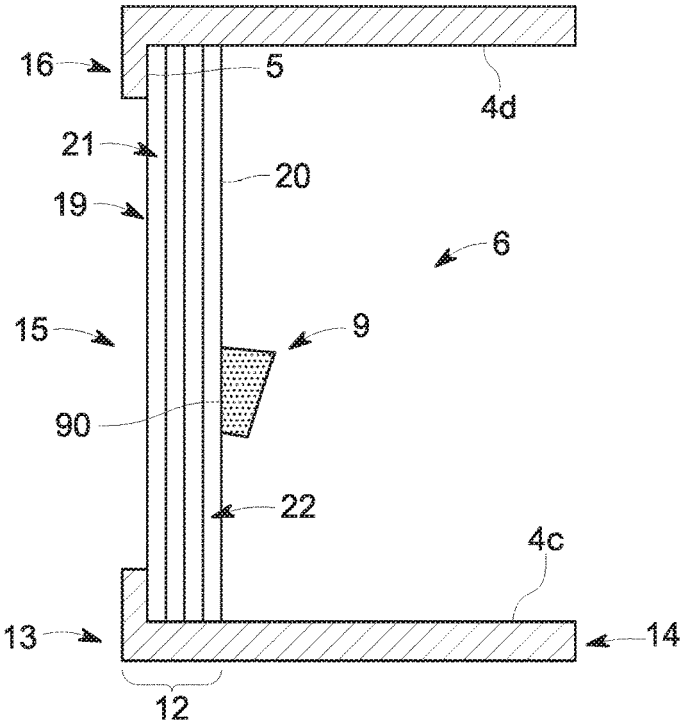
FIG. 7 is a side view of a transverse cross-section of the example frame of FIG. 6 along line A.

As further shown at FIGS. 2A and 7, rod [9] may be mounted to secure one or more panels [12] within the body [2] of frame [1]. When secured, a plurality of panels [12], for example four panels may be disposed between the rod [9] and the interior lip [5] of the front border [16]. A front side of a front panel of the plurality of panels is kept flush with the interior lip [5] of the front border [16]. The rod [9] keeps the one or more panels [12] stored and secured within the cavity [6] of the frame.

In one example, interior lip [5] may be substantially perpendicular to the front side [13] of the body. In other examples where the front side of the body [13] is rounded, the angle or curvature of the interior lip [5] may vary, for example, the interior lip may form an angle with a side of the frame that is greater or lesser than [90° ].

To secure the panels within the frame, rod [9] may be advanced along the first and second channels [7, 8] toward the front side [13] of the body, the rod [9] engages and exerts a force against the back side of the at least one panel [12] (or the back side of the rear panel of a plurality of panels), while the interior lip [5] of the front border [16] engages and exerts a force against the front side of the panel [12] (or the front side of the front panel of a plurality of panels) to secure the panel within the body of the frame. When rod [9] is secured against the back of a panel (or the back of a rear panel if there are multiple panels), the rod engages the back side of the panel and exerts a compressive force in a direction perpendicular to a plane formed at the area or line of contact between the rod and the back side of the panel, and the interior lip [5] of the front border [16] of the body of the frame also exerts a compressive force against the front side of the panel in the opposite direction that is perpendicular to the plane. In this example, the opposing compressive forces are uniaxial (imposed along the same axis) and interact to secure or pinch the panels in place within the frame.

As shown in FIG. 1, in one example, the first and second channels [7, 8] are open on one end at the back end of the channel at the back side of body [2], thus rod [9] may exit the first and second channel by moving along the track defined by the channels to the open end of the first and second channel. In other examples, the first and second channel [7, 8] are enclosed within the one or more interior surface [3] (or for example as shown in FIG. 1, within first interior surface [4*a*] and second interior surface [4*b*]) do not open to the back side of body [2], such that the rod remains contained within the cavity of body [2] and may be moved along the track to place one or more panels within the cavity.

In one example, rod [9] may be further reinforced or secured by securing means disposed in the first or second channel [7, 8], or on or within rod [9]. The securing means may include but is not limited to mechanical clasps, wedges, springs, or magnets. These securing means may also be disposed on a panel [12] such to further secure or stabilize the rod [9] when secured against the panels. In another example wherein the first or second end [10, 11] of the rod is accessible to the exterior of the frame, rod [9] may be secured by securing means as described above.

In another example, the rod [9] is wider in diameter (or substantially wider) in the middle than on the first or second end [10, 11]. In an example with a wider middle to the rod [9] (for example, football-shaped), one or more panels [12] that are curved may be more suitably accommodated. Rod [9] itself also may be curved, in some examples, to better secure a curved or planar panel [12].

In one example, rod [9] is kept in contact with the panels [12] by compression force of the panel [12] in contact with the interior lip [3]. The first and second channels [7, 8] also act against the rod [9] by compression force and friction. Rod [9] also exerts force against the panels [12] by force of gravity. In general, the panels become secured within the frame when rod [9] advances forward in the channels to the point where there is an intersection between the rod and the back side [20] of the panel, and where the panel begins to impede upon and narrow the width of the channel [7, 8] into which the rod can advance, such that the rod cannot advance further within the channel without deforming the panel, rod, or channel. When a user advances the rod forward in the channel in this manner, a user may remove the force being applied on the rod and the rod may stay in place as compressive forces retain the rod between the panel and back side of the channel. This interaction takes place due to the fact that the channels are oriented and formed within the at least one interior surface of the body at angles that differ from the angle at which the panels are oriented within the cavity of the body when placed against the interior lip of the frame. For example, a plane in which the channels are disposed is not parallel to the plane in which the one or more panels are disposed against the interior lip within the frame. Further, in this example, when the rod slidably engages and is advanced forward in the first and second channels toward the front of the frame, the intersection of the plane in which the channels are disposed and the plane in which the panel is disposed forms an acute angle.

As discussed above, various components of the frame may be made of medium or high density fiber board. Alternatively, such components may be made of other materials, such as metal (e.g., aluminum or steel), a relatively hard wood, such as poplar or pine, plastic, Plexiglas, or other material with sufficient hardness and rigidness. The material must be hard enough to resist (or mostly resist) permanent deforming (e.g., the forming of divots) in, for example, the first or second channels [7, 8] caused by the rod [9] and the forces thereon.

In some examples, a transparent panel may be temporarily or permanently disposed in front of a front panel, co-planar with and interior to the front border, or in front of and attached to the front border. Such a transparent panel may be designed to protect the panels within the frame. The transparent panel may be composed of, for example, plastic, Plexiglas, or glass.

In one example, the first channel [7] and second channel [8] are oriented at angle [50] of approximately 15° to 20° from a vertical plane co-planar with interior lip [5]. In other examples, first channel [7] and second channel [8] may be oriented at an angle of approximately 1° to approximately 44° from the plane that is co-planar with the surface of interior lip [5].

In still other examples, first channel [7] and second channel [8] may be oriented at an angle of approximately 46° to approximately 89° from a vertical plane that is co-planar with interior lip [5]. In one example the first channel [7] and second channel [8] run across entire length of the first and second interior surfaces, respectively. In another example the first and second channels run across only a portion of the first and second interior surfaces [4*a*, 4*b*].

In one example first and second channels [7, 8] are approximately 5 millimeters in depth, and the first and second sides of body [2] (and generally, the four walls of a square-shaped frame) of which the respective first and second interior surfaces [4*a*, 4*b*] are a part are approximately 7 millimeters in width. The frame and frame system disclosed herein can vary in size, so the depth of the channels and widths of sides of the body of frames can vary accordingly as well. In another example, one or both of first and second channels [7, 8] is the same depth as the first and second sides of body [2] of which the respective first and second interior surfaces [4*a*, 4*b*] are a part, and thus the respective first or second ends [10, 11] (or both) rod [9] is exposed to the exterior of the frame.

In some examples of frames or frame systems of this disclosure, there may be a plurality of frames within one article, each frame with one or more rods for securing panels. Such examples may include but are not limited to calendars with removable and replaceable art work in one area of the apparatus, and removable and replaceable day and month depictions in other areas of the apparatus. In other examples, more than one set of channels (e.g., sets of two channels), each with its own respective rod, may be utilized to further secure a single panel within a frame. For example, such a configuration may be utilized for large-sized frames. This disclosure contemplates frames of many different sizes may be implemented according to the configurations and techniques disclosed herein.

Figure 8:
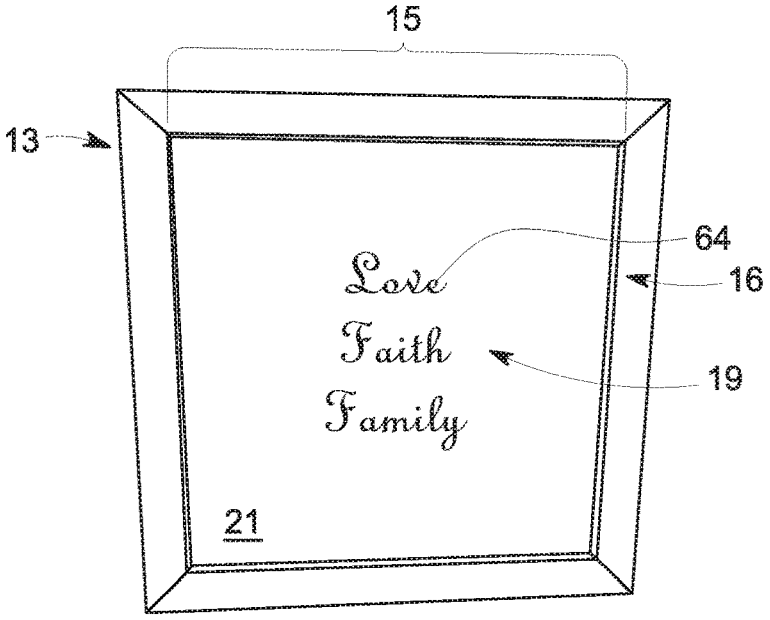
FIG. 8 is a view from the front side of the example frame of FIG. 6 showing a front panel that is flush with and secured against an interior lip of a front border of the body of the frame.

In some examples, an image [60] may be disposed on a front side of at least one panel [12], such as art. For example, when at least one panel [12] is secured within body [2] of frame [1] by rod [9], image [60] is viewable from the front through window [15], as shown at FIG. 8. In some of these examples, a different, second image [62] may be disposed on the opposite side of panel [12]. The panels are reversible such that either the front or back side of the panel may be selected by a user to display a desired image [60] or [62] through the window [15]. In other examples the one or more panels [12] may have an image on only one side. In some examples the frame or frame systems as disclosed herein that include such panels with images, may include or be referred to as an art box frame or display frame.

Image [60] on one or more panels [12] may be various forms of art, such as a holiday, Christmas, Easter, or Fourth of July-related image. Other images may include, for example, nature scenes, characters, or company logos. This disclosure contemplates that other forms of images may also be rendered on the panels [12], in any suitable medium, such as original paintings or drawings, reproduced images of paintings or drawings, an image imprinted on, or an image disposed on paper that is glued on the panel.

As noted, an image [60] or second image [62] also may be printed, created, or otherwise disposed on another material (e.g., on paper) which is then attached to the front or back, respectively of panel [12]. For example, a piece of paper showing printed artwork may be glued to the front of a panel for display through window [15]. Any suitable manner of fastening a material displaying an image to a panel may be utilized.

In other examples, slogans, sayings, poems, written notices, or other text may be disposed on one or more panels [12]. For example, a written notice on the panels [12] may include a meeting notice, instructions or an agenda for meeting attendees, a greeting, a warning, or any other message.

In one example the panels [12] may be made of plywood. In other examples, the panels [12] may be made of medium or high density fiberboard, Plexiglas, or cardboard. Alternatively, panels [12] can be made of any rigid material suitable for the panels [12] to be easily handled by the user, and stacked in the cavity [6].

In one example, the panels [12] are affixed with art or other designs and a layer of foam or other cushioning material is disposed between the art and the panel [12]. In another example the panels [12] are rigid on only one side.

Figure 6:
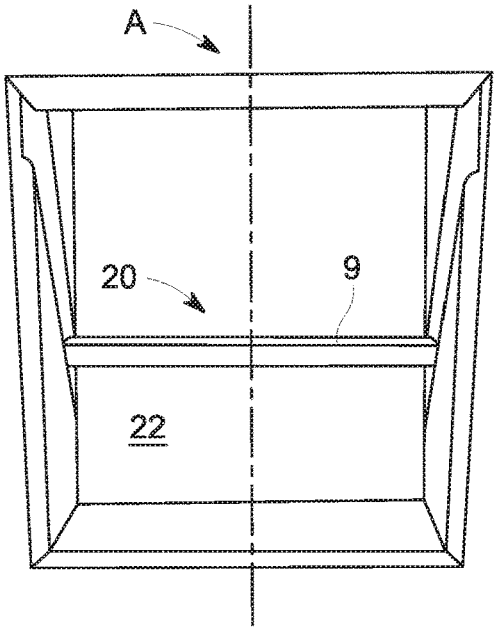
FIG. 6 is a perspective view from the back side of the example frame of FIG. 5 with panels disposed fully within a cavity within the body of the frame and a rod disposed in the first and second channels securing the panels in place.

One or more panels [12] are generally shaped to be relatively thin and fit within cavity [6] of body [2] and displayed through window [15]. Thus, a perimeter of one or more panels [12] generally will fit within the front end of body [2] defined by one or more interior surfaces, for example, as shown at FIGS. 6, 7 and 8. However, the front side of one or more panels [12] need not entirely fill window [15].

FIG. 2A is a perspective view of an example rod [9] with a trapezoidal transverse cross-section, as described herein as part of a frame or frame system. One side of the rod forms a right angle in its transverse cross-section, while a front side [90] is tapered. The cross-section of the rod tapers due to its trapezoidal shape, which aids in its securing of one or more panels as rod [9] is advanced toward the front side of body [2] of frame [1].

Figure 2B:
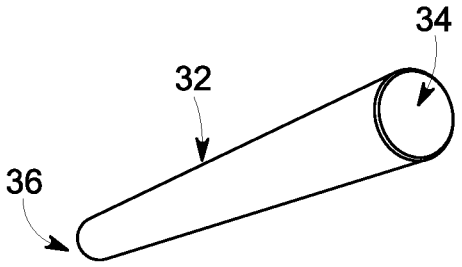
FIG. 2B is a perspective view of an example rod with a circular transverse cross-section, as described herein as part of a frame or frame system.

FIG. 2B is a perspective view of an example rod [32] with a circular transverse cross-section, as described herein as part of a frame or frame system. Rod 32 has a first end 34 and a second end 36. In general, rod [9] or [32] may be a wooden dowel. For example, the dowel may be made of poplar, pine, or any relatively hard wood. Alternatively, the rod may be composed of metal, such as aluminum, or plastic. In general, the rod may be made of any material with sufficient hardness and rigidness, to avoid or limit permanent deformation of the rod when it is repeatedly secured within the channels.

In some examples, a rod as contemplated by this disclosure may be shaped like a cylinder, with a substantially similar diameter of a circle in its transverse cross-section throughout its length, as shown in FIG. 2B. In other examples, the transverse cross-section of a rod may be a polygon, such as a trapezoid as shown at FIG. 2A. In other examples, the diameter of the rod may vary along its length. For example, the diameter may increase toward the middle of the rod and taper toward the ends of the rod, to apply pressure more directly to the center of the panel when secured.

In another example the rod may be triangular in shape. In one such example, the transverse cross-section of rod may form an isosceles triangle. When such a rod is engaged with the back side of a panel to secure the panel, for example, one of the two sides of equal length may engage the back side of panel [12], and the other side of equal length may engage a rear wall of the channel. In other examples, a transverse cross-section of the rod may form a triangle that is not isosceles. In some examples, a triangular rod design may provide greater strength or durability as compared to other rod shapes.

In some examples, rod may have a transverse cross-section that is square, rectangular, or another polygon. Other shapes of rods may be utilized as well that may sufficiently secure one or more panels within the frame.

In some examples, the rod may be tapered in diameter at its first and second ends, as compared to the diameter of other segments of the length of the rod. In one example, a circular rod may be approximately 9.5 millimeters in diameter, approximately 14.5 centimeters in length, and the first and second channels [7, 8] are approximately 10 millimeters in width, although many different lengths and sizes are contemplated by this disclosure. In examples where the first and second ends of the rod [10, 11] have a diameter approximately equal to the width of the first and second channels [7, 8], or a larger surface area of contact between panel and rod such as the trapezoid-shaped example rod [9] of FIG. 2A, the channels may be less likely to deform due to pressure from the rod [9] when being secured, as forces may be spread out over larger surface area as compared to a rod of smaller area of contact.

In another example, such as a trapezoid-shaped rod such as rod 9 shown in FIG. 2A, an example rod may be approximately 14 to 15.5 centimeters in length, 28.5 millimeters in width, 9.5 millimeters in height on its longer side, and 4.7 millimeters in height on its shorter size of the trapezoid shape in transverse cross-section. Many different lengths and sizes of dimensions of rods (and frames, with associated panels) are contemplated by this disclosure. Further in some examples the first and second channel [7, 8] may be greater (or substantially greater) in width than the diameter of the first and second ends [10, 11] of the rod [9].

As noted, rod [9] may slide along the path formed by first channel [7] and second channel [8]. As one or more panels [12] are inserted or removed [see, e.g., FIGS. 5, 7, and 9], rod [9] is adjustable and moves along the channels to keep the panels [12] secure and the front side [19] of a front panel [21] of a plurality of panels (or a single panel, in some cases) flush with the interior lip [4] of the frame [1] (see FIG. 7). Rod [9] also is adjustable along the channels [12] for the selective securing and storing of different numbers of panels [12] within cavity [6].

Figure 3A:
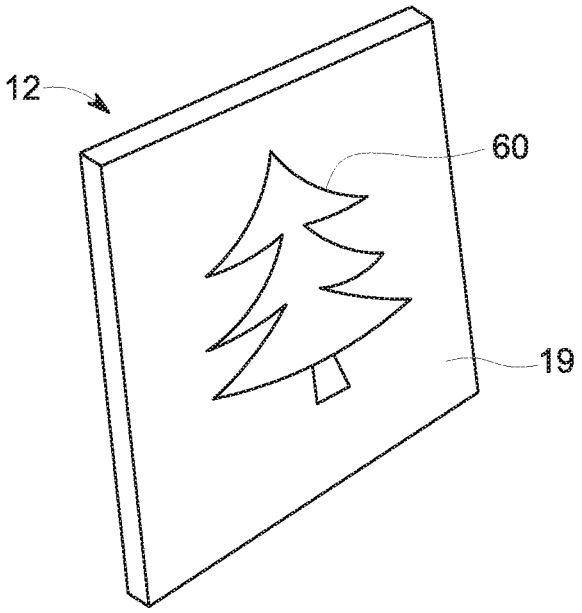
FIG. 3A is a perspective view of the front of an example reversible panel that shows an example image displayed on the front side of the panel, as described herein as part of a frame system.

FIG. 3A is a perspective view of the front of an example reversible panel [12] that shows an example image [60] displayed on the front side [19] of the panel, for example artwork of a holiday Christmas tree.

Figure 3B:
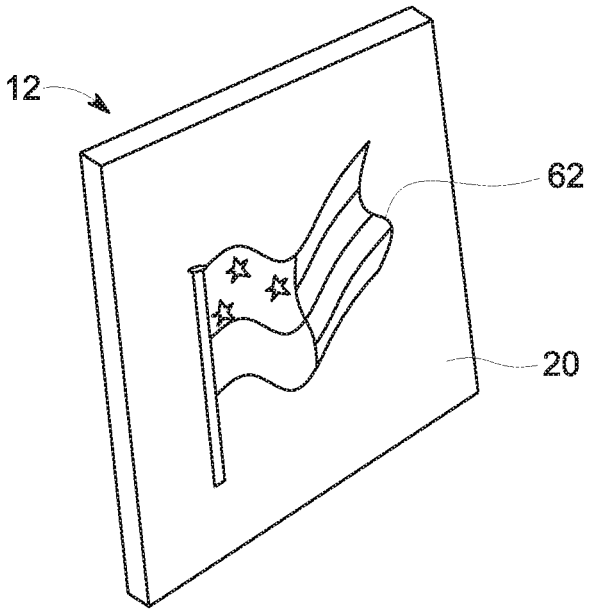
FIG. 3B is a perspective view of the back side of the example reversible panel of FIG. 3A that shows a second image displayed on the back side of the panel.

FIG. 3B is a perspective view of the back side [20] of the example reversible panel [12] of FIG. 3A that shows a different second image [62] displayed on the back side of the panel, for example artwork of a patriotic flag.

FIG. 4 is a perspective view from the back side of an example frame [1] that shows interior lip [5] of body [2] that protrudes inwardly at the front side of the example frame, among other features. In one example interior lip [5] is integrally formed with the front border [16]. In other examples, interior lip [5] may be separate from and joined with or attached to the front border. For such separate components (including other such separate components of the body), the components may be joined together by any known process in the art, such as adhesive, glue, mechanically engaging joints, magnets, pins, clasps, or the like. In some examples, there may be a plurality of separately spaced interior lips [5] of different dimensions that are part of the frame border [16].

Figure 5:
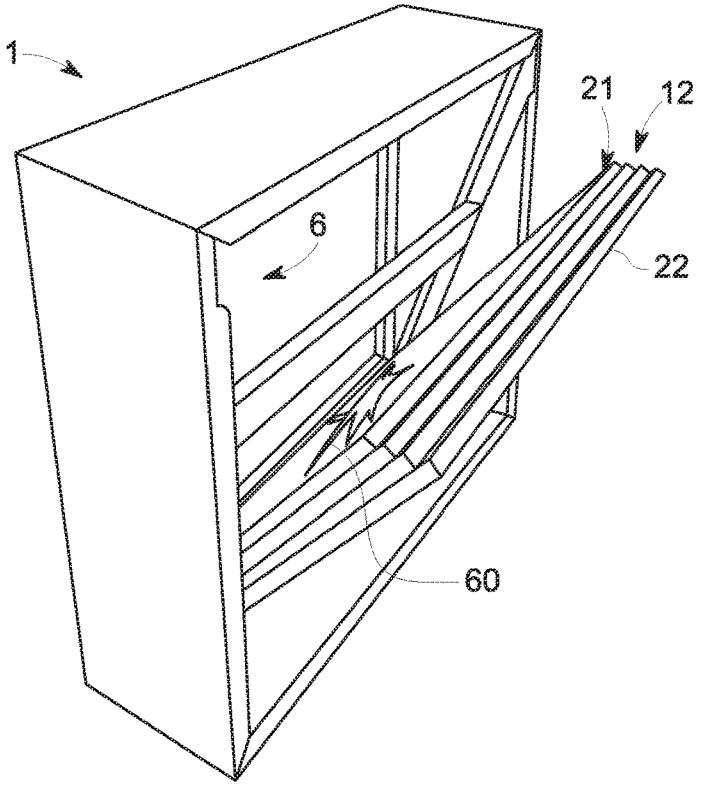
FIG. 5 is a perspective side view of an example frame with a plurality of panels disposed partially in a cavity within the body of the frame.

FIG. 5 is a perspective side view of an example frame [1] with a plurality of panels [12] disposed partially in cavity [6] within body [2] of frame [1]. As shown in FIG. 5, a plurality of panels [12] may be stored within cavity [6] of body [2] of the frame according to the present disclosure. The stored panels also are easily accessible and interchangeable, such that different panels may be selected to display different images through window [15]. When secured with rod [9], any image or text on the front side of front panel [21] may be displayed. Other panels [12] may readily be removed and placed in the front of front panel [21] and thus be displayed in the frame. Front panel [21] of plurality of panels [12] is displayed through window [15] as shown in FIG. 8. As shown in FIGS. 3A and 3B, some or all of plurality of panels [12] may be reversible such they may have a first image [60] on a first side and a different second image [62] on a second side, permitting a user to select from images or text on multiple panels and multiple sides of each panel for display in frame [1] through window [15]. In some examples, each image disposed on each side of a panel is distinct, such that there are no repeated images. For example, a set of four panels may present eight distinct images that can be displayed in the frame.

One or more panels [12] may be removed from cavity [6] in body [2] of frame [1] without rod [9] needing to be removed. In other cases, rod [9] may be removed while panels are removed or interchanged. In some examples, first and second channels [7, 8] may not extend to and open to the back side of the frame as shown in FIG. 4. In such cases, the channels may terminate within the at least one interior surface [3] of the body.

FIG. 6 is a perspective view from the back side of the example frame of FIG. 4 with a plurality of panels [12] disposed fully within a cavity within the body of the frame and rod [9] disposed in the first and second channels securing the panels in place. As shown in FIG. 6, rod [9] secures the back side [20] of a rear panel [22] of plurality of panels [12]. For example, rod [9] engages and exerts a compressive force against back side [20] of panel in a direction substantially perpendicular (or perpendicular) to a plane formed at the area of contact between the rod and the back side of the panel (in this example, a substantially rectangular area along the length of rod [9] of the example frame), and the interior lip [5] of the front border [16] of the body of the frame exerts a compressive force against the front side of the panel in the opposite direction that is perpendicular to the plane. The compressive force the interior lip exerts against the front side of the panel when the rod secures the back side of at least one panel is applied along the areas of engagement and contact between the front side of the panel and interior lip, for example, around the outside perimeter of the front side of the panel as shown at FIG. 7.

With respect to the example rod [32] with a circular cross section, the rod engages and exerts a compressive force against back side of a panel at the point of contact along between the rod and panel along the length of the rod.

FIG. 7 is a cross-sectional side view of the example frame of FIG. 6 along line A. As noted, FIG. 7 shows front side [90] of rod [9] engaged with and exerting a force (e.g., a compressive force) against a back side [20] of a rear panel [22], this compressive force being in a direction toward front side [13] of the frame, and interior lip [5] engaging with and exerting a force (e.g., a compressive force) against front side [19] of a front panel [21] of plurality of panels [12] in an opposite direction toward back side of the frame.

A frame system also is disclosed herein, for example, as shown at FIGS. 6 and 7, with certain components thereof also described in connection with other Figures herein. The frame system may include a body [2] including at least one interior surface [3], as described herein. In the examples shown at FIGS. 6 and 7, the frame system includes a frame with four interior surfaces as described herein with respect to FIG. 1. Front side [13] of body [9] may include a front border [16] with an interior lip [5]. The frame system also may include, as stated, at a first interior surface [4*a*] and second interior surface [4*b*], on which respective first and second channels are formed. A cavity [6] is defined by the one or more interior surfaces, in to which panels may be disposed.

Again, a first channel [7] may be disposed on first interior surface [4*a*], while a second channel [8] may be disposed on second interior surface [4*b*]. In some examples, there may be a plurality of interior surfaces, such as four interior surfaces that connect at their ends and form a square or rectangle). In some examples, a single interior surface may include a oblong or circular shape. In another example, a single exterior surface may be substantially square or rectangular in its cross section with rounded corners. One or more interior surfaces may include sets of channels that receive respective rods therein to secure panels at multiple points, or to secure multiple panels within a larger frame or frame system. An example rod, such as rod [9] or [32] of the frame system, extends from the first channel [7] to the second channel [8]. The rod fits into the channels and can slide along the track defined by the channels. The rod includes a first end [10] and a second end [11]. For example, first end [10] of rod [9] slidably engages first channel [7] and second end of rod [11] slidably engages second channel [8]. The rod is advanced along the channels toward the front of the frame to secure one or more panels [12] within the frame.

Rod [9] or [32] slides along the track formed by the first channel [7] and the second channel [8]. As panels [12] are selectively inserted, removed, or interchanged by a user, the rod is adjustable to account for different numbers of interchangeable panels, yet keeps a front side of a front panel of a plurality of panels [12] flush with the interior lip [5] of the body [2]. The rod is thus adjustable and the frame may be configured to display one panel [12] and store other panels [12] in cavity [6] behind the displayed panel.

Example rod [9] may be moved rearwardly along the track formed by the described channels to release the forces keeping the panels [12] secure and allow a user to selectively add, remove, interchange or store different panels [12] with images on one or both sides thereof. For example, a first image of artwork, text, a photograph, holiday or seasonal items may be displayed on the front side of a panel, and a second image bearing alternative such content may be displayed on a back side of the panel.

FIG. 8 is a view from the front side [13] of the body of the example frame of FIG. 6 showing a front panel [21] of a plurality of panels, where the front side [19] of front panel [21] is flush with and secured against interior lip [5] of front border [16] of body [2] of frame [1]. In FIG. 6, front side [19] and an example image [64] of inspirational text disposed on front side [19] of front panel [21] are visible through window [15].

Figure 9:
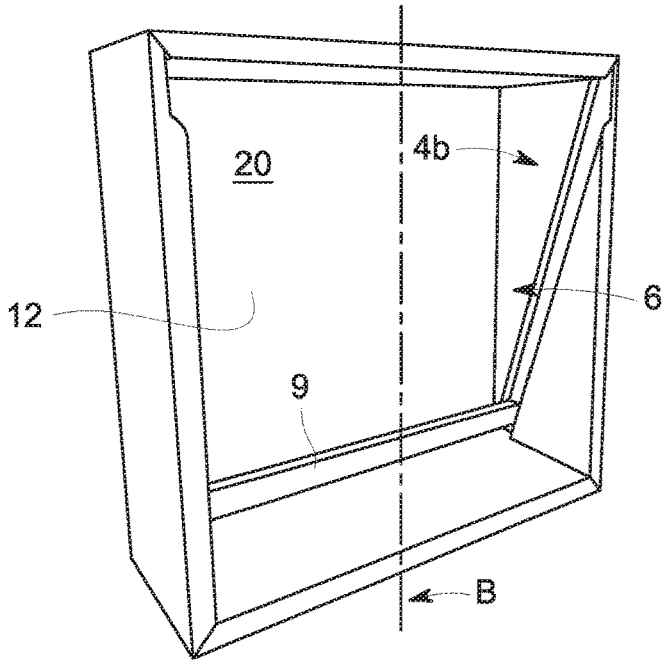
FIG. 9 is a perspective view from the back side of an example frame with a single panel disposed within a cavity within the body of the frame and a rod disposed in the first and second channels securing the panel in place.

FIG. 9 is a perspective view from the back side of an example frame [1] with a single panel [12] disposed within cavity [6] within the body of the frame and a rod [9] disposed in the first and second channels securing the panel in place, in the manner described herein.

Figure 10:
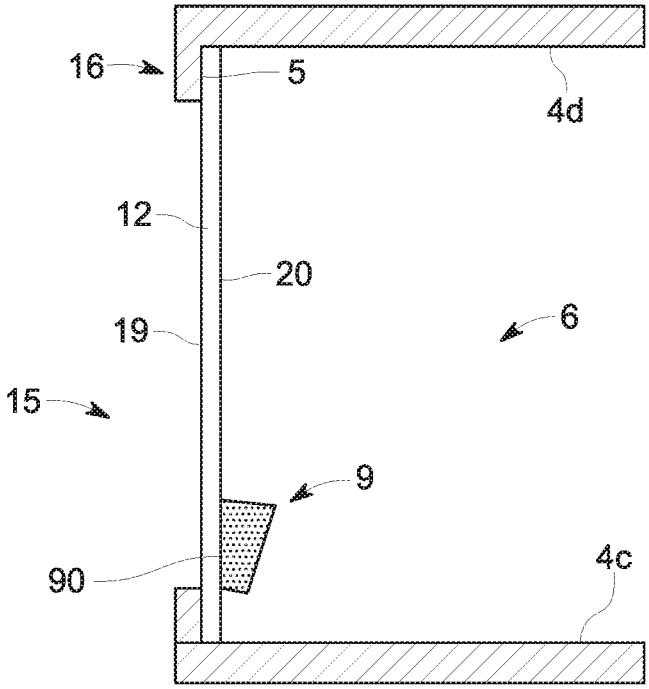
FIG. 10 is a side view of a transverse cross-section of the example frame of FIG. 9 along line B.

FIG. 10 is a side view of transverse cross-section of the example frame of FIG. 9 along line B. As described herein, rod [9] is engaged and exerts a compressive force against back side [20] of panel [12] in a direction perpendicular to a plane formed at the area of contact between the rod and the back side of the panel. Further, interior lip [5] of front border [16] exerts a compressive force against front side [19] of panel [12] in the opposite direction that is perpendicular to the referenced plane.

Figure 11:
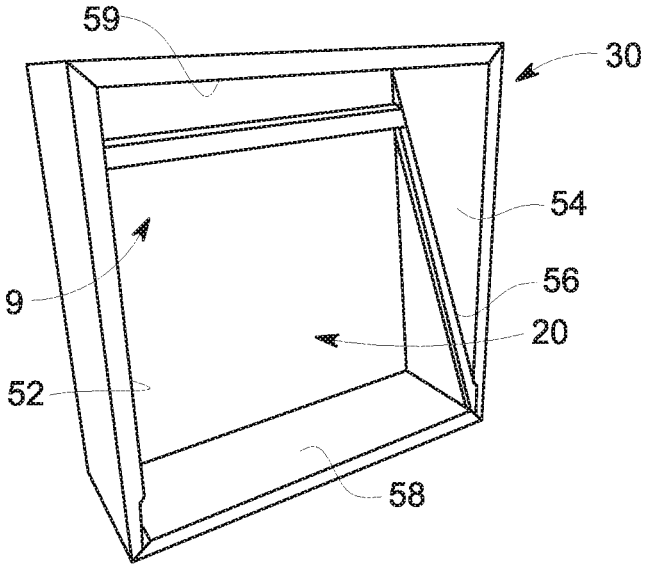
FIG. 11 is a perspective view of another example frame showing a rod disposed in first and second channels to secure panels within the frame, wherein the channels are oriented upward on interior surfaces of the body of the frame when viewed from the back side of the frame toward the front side of the frame.

FIG. 11 is a perspective view of another example frame [30] of the present disclosure that shows a rod [9] disposed in first and second channels to secure panels within the frame. The first channel does not appear in FIG. 11 but is parallel to and in the same orientation on first interior surface [52] of the frame as the second channel [56] disposed on second interior surface [54]. In this example, the channels are oriented upward on interior surfaces of the body of the frame when viewed from the back side of the frame toward the front side of the frame. In this configuration, as described above, in addition to the compressive forces being exerted on the rearmost panel by the rod and on the front panel by the interior lip, the rod relies more readily on friction to stay in place than on gravity in previously described configurations, where the channels are oriented downward when viewed from the back side to the front side of the frame.

Figure 12:
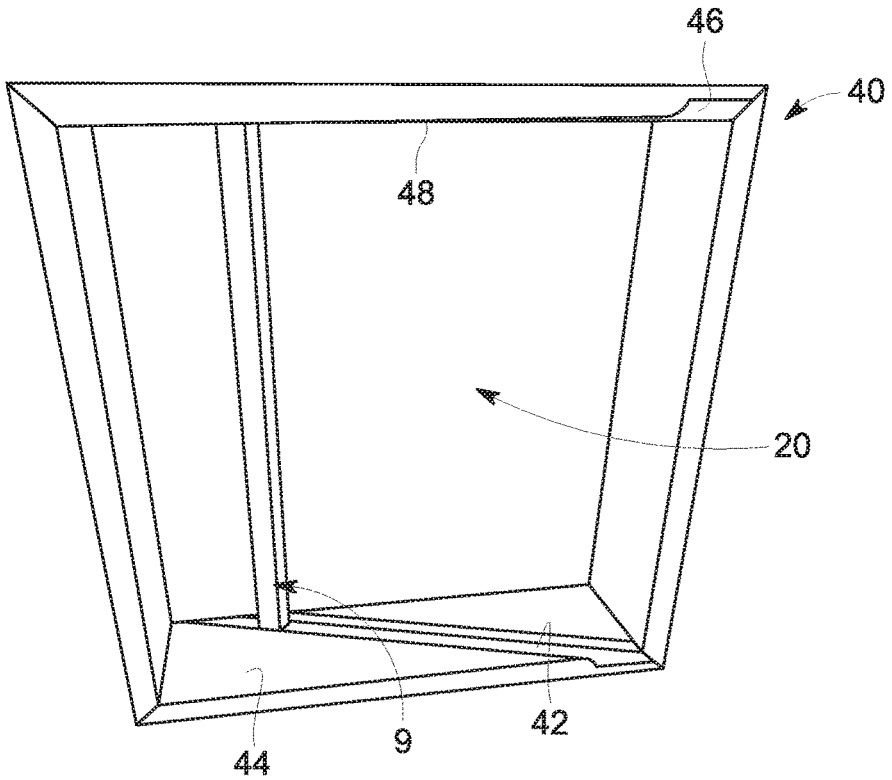
FIG. 12 is a perspective view of another example frame showing a rod disposed in first and second channels to secure panels within the frame, wherein the channels are respectively oriented on a bottom interior surface and a top interior surface of the body of the frame.

FIG. 12 is a perspective view of another example frame [40] of the present disclosure, which shows a rod [9] disposed in first and second channels to secure panels within the frame. In this example, a first channel [42] is formed on a bottom interior surface [44] and a second channel [46] on a top interior surface [48] of the body of the frame, such that rod [9] is oriented vertically. In this example, the front end of the channels is more proximate to the front side of the frame than the back end of the channels, as oriented on the respective top and bottom interior surfaces. In some examples, regardless of the portions of the interior surfaces on which they are formed, the two respective channels in which opposing ends of a rod are disposed are generally equidistant from one another along a portion (or all) of the length of the channels. In other examples, such as a circular or oblong shaped frame, first and second channels may be disposed on respective first portion and second portion of the interior surface of the circular or oblong shaped frame, such that the first and second channels are on opposing sides of the interior surface. In this example, portions of the channels may be varying distances apart at certain places along the frame.

Figure 13:
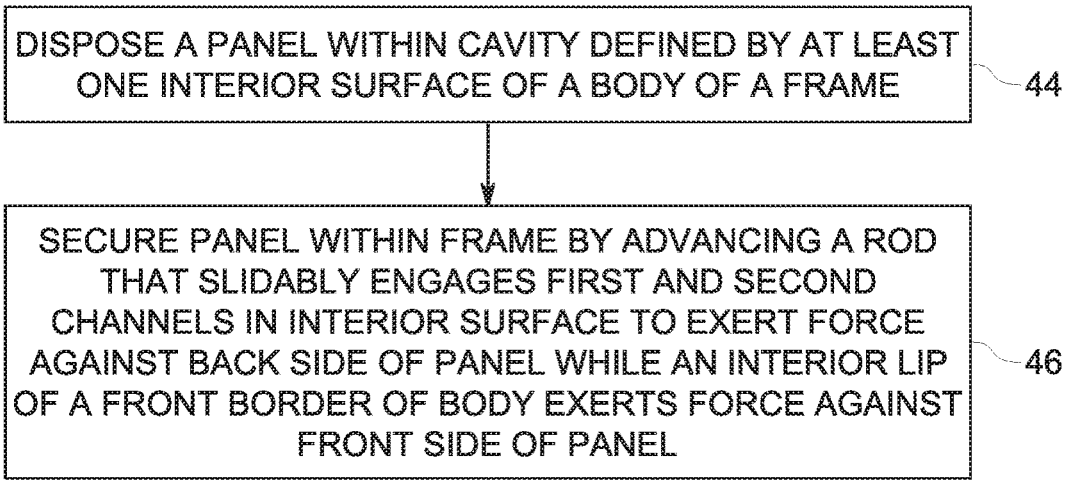
FIG. 13 is a flow diagram illustrating an example technique for securing a panel within a frame.

FIG. 13 is a flow diagram illustrating an example technique for securing a panel within a frame and displaying an image or other text on a panel [12], as described herein, while in some cases storing additional panels [12] behind the displayed panel [12] and within a cavity of the body of the frame. The described techniques allow for selectively determining the number of panels to store within the frame, and adjusting the position of the rod within the channels to account for the number of panels. The techniques disclosed herein also permit a user to select from multiple distinct images on each of multiple reversible panels that are conveniently stored and secured within the frame. Some of the disclosed techniques also allow for interchanging images displayed on single panels within the frame, or on different panels within the frame.

The disclosed technique includes a step [44] of disposing a panel [12] within a cavity [6] defined by at least one interior surface [3] of a body [2] of a frame [1]. As described elsewhere herein, in an example technique, a first channel [7] may be disposed on a first interior surface [4*a*] (or on a first portion of a single interior surface) and a second channel [8] disposed on a second interior surface [4*b*] (or an opposing second portion of a single interior surface) of the body [2] of example frame [1], as shown in FIG. 1. Further, in some frames utilized for the example technique, front ends of each of the first and second channels are more proximate to front side [13] of the body than back ends of each of the first and second channels. For example, as shown in FIG. 1, front end [17] of first channel [7] and front end

[77] of second channel [8] are more proximate to front side [13] of body [2] than back end [18] of first channel [7] and back end [88] of second channel [8]. In some cases, the body may includes a front border [16] that defines a window [15] through which the front side of the panel may be viewed.

In example techniques, a frame utilized includes a rod as described herein, for example rod [9] or [32] that extends from the first channel to the second channel, such that a first end [10] of the rod is disposed in and slidably engages the first channel and a second end [11] of the rod is disposed in and slidably engages the second channel.

A next step [46] of the example technique includes securing one or more panels within the frame. In some such examples, securing the panel includes disposing the rod in the first and second channels then advancing the rod toward the respective front ends of the first and second channels until the rod engages a back side [20] of the panel (or the rearmost panel, where a plurality of panels are disposed within the cavity of the body) and exerts a force against the back side of the panel, while an interior lip [5] of the front border [16] of the body of the frame exerts a force against the front side [19] of the panel (or the front panel, where a plurality of panels are disposed within the cavity of the body). For example, first end [10] of rod [9] slidably engages first channel [7] while second end [11] of rod [9] slidably engages second channel 8.

As described herein, rod [9] engages the back side of the panel [12] and exerts a compressive force against the back side of the panel in a direction perpendicular to a plane formed at the area or line of contact between the rod and the back side of the panel, and the interior lip [3] of the front border [16] of the body of the frame exerts a compressive force against the front side of the panel in the opposite direction that is perpendicular to the plane. Some or all of one or more surfaces of an example rod may contact the back of a panel.

After securing the panel [12] within the frame, an example technique also may include a user advancing rod [9] toward the back end of each of the first and second channels to remove the rod from the first and second channels (or at least release the compressive pressure the rod was exerting on the one or more panels), followed by removing the panel from the cavity, flipping over the panel, and disposing the panel within the cavity so that a back side of the panel (e.g., a second image thereon) may be viewed through the window [15]. A next step of the technique may include securing the panel [12] within the frame, wherein securing the panel is accomplished (as described) by advancing the rod [9] toward the respective front ends of the first and second channels [17, 18] until the rod engages the front side of the (flipped) panel [19] and exerts a compressive force against the front side of the panel in a direction perpendicular to a plane formed at the area or line of contact between the rod and the front side of the panel, such that the interior lip of the front border of the body of the frame exerts a compressive force against the back side of the panel [20] in the opposite direction that is perpendicular to the plane.

In some examples, a technique includes securing a plurality of panels [12] within the frame [1], such that rod [9] engages a back side [20] of a rear panel [22] of the plurality of panels [12] and exerts a force against the back side of the rear panel. In this example, the interior lip [5] of the front border of the body of the frame may exert a force against a front side [19] of a front panel [21] of the plurality of panels. In some such examples, each panel of the plurality of panels includes a distinct image.

In another example technique, after securing the plurality of panels [12] within the frame [1] as described, the technique includes a user advancing an example rod toward the back end of each of the first and second channels to remove the rod from the first and second channels, or from exerting a compressive force on the panels if the channels do not open to the back of the frame and the channels are enclosed within the at least one interior surface of the body. The technique may further include selectively removing from the cavity [6] one of the plurality of panels [12] that is not the front panel then disposing the removed panel within the cavity in front of the multiple panels, so that the selected image is displayed through the window of the frame.

The invention claimed is:

1. A frame comprising:

a body including at least one interior surface that defines a cavity, wherein a first channel is disposed on a first portion of the interior surface and a second channel is disposed on a second portion of the interior surface, the first channel is configured to receive a first end of a rod and the second channel is configured to receive a second end of the rod such that the rod extends between and slidably engages the first and second channels, and wherein the cavity is configured to receive at least one panel, and the body further includes a front border that defines a window, wherein the front border comprises an interior lip that protrudes inwardly toward the center of the frame from the at least one interior surface of the body of the frame, and wherein the body further comprises a front side and a back side, wherein the at least one interior surface extends from the front side to the back side of the body, and wherein each of the first channel and second channel includes a front end and a back end, wherein the front end of each of the first and second channels is more proximate to the front side of the body than the back end of each of the first and second channels.

2. The frame of claim 1, wherein the cavity within the body of the frame is configured to receive and store a plurality of panels.

3. The frame of claim 1, wherein when the at least one panel is disposed in the cavity within the body, the interior lip of the front border of the body of the frame is configured to engage a front side of the at least one panel when the back side of the panel is secured by the rod.

4. The frame of claim 3, wherein when the at least one panel is disposed in the cavity within the body, a front side of the at least one panel includes an image viewable through the window defined by the front border of the body of the frame.

5. The frame of claim 1, wherein when the at least one panel is disposed within the cavity, when the first end of the rod is disposed in the back end of the first channel and the second end of the rod is disposed in the back end of the second channel, and when the rod is advanced from the back end of each of the first and second channels toward the front end of each of the first and second channels, the rod is configured to engage and exert a compressive force against a back side of the at least one panel to secure the panel within the frame, such that the interior lip of the front border of the body engages a front side of the panel.

6. The frame of claim 1, wherein the at least one interior surface comprises a plurality of interior surfaces, wherein the first channel is disposed on a first interior surface of the plurality of interior surfaces and the second channel is disposed on a second interior surface of the plurality of interior surfaces, wherein the first interior surface is substantially parallel to the second interior surface, and wherein a third interior surface of the plurality of interior surfaces extends between the first and second interior surfaces, and wherein a fourth interior surface is substantially parallel to the third interior surface and extends between the first and second interior surface to define the cavity.

7. The frame of claim 6, wherein the body of the frame is substantially square in its longitudinal cross-section.

8. The frame of claim 1, wherein the body in its longitudinal cross-section is one of square, rectangular, polygonal, curvilinear, circular, oblong, or a combination of one or more of these shapes.

9. The frame of claim 1, wherein the first and second channels disposed on the at least one interior surface are substantially parallel to one another and oriented at respective angles of approximately 15 to 20 degrees measured from a vertical plane co-planar with the interior lip of the front border of the body.

10. A frame system comprising:

a body comprising at least one interior surface that defines a cavity and a front border that includes an interior lip, wherein a first channel is disposed on a first portion of the at least one interior surface and a second channel is disposed on a second portion of the at least one interior surface, the interior lip protrudes inwardly toward the center of the frame from the at least one interior surface, and the front border defines a window, wherein the body further comprises a front side and a back side, wherein the at least one interior surface extends from the front side to the back side of the body, and wherein each of the first channel and second channel includes a front end and a back end, wherein the front end of each of the first and second channels is more proximate to the front side of the body than the back end of each of the first and second channels; and a rod that extends between the first channel and the second channel, such that a first end of the rod slidably engages the first channel and a second end of the rod slidably engages the second channel.

11. The frame system of claim 10, further comprising:

at least one panel disposed within the cavity.

12. The frame system of claim 11, wherein the rod is configured to advance along the first and second channels from the back side of the body toward the front side of the body to engage a back side of the at least one panel, such that a front side of the panel is engaged by the interior lip of the front border of the body to secure the panel within the frame.

13. The frame system of claim 11, wherein a front side of the at least one panel includes a first image and a back side of the panel includes a second image, wherein the second image is distinct from the first image, and wherein the first and second images each comprises one of artwork, text, a photograph, a holiday image, or a seasonal image, or a combination thereof.

14. The frame system of claim 10, wherein a plurality of panels are disposed within the cavity, and wherein a first image is disposed on a front side of each of the plurality of panels and a second image is disposed on a back side of each of the plurality of panels, such that the first image on the front side of a front panel of the plurality of panels is viewable through the window defined by the front panel of the body of the frame, and wherein each respective image is distinct.

15. The frame system of claim 10, wherein the rod is rectangular, square, trapezoidal, circular, or curvilinear in its transverse cross-section.

16. The frame system of claim 10, wherein the first and second channels are parallel and oriented at angles of between one and eighty-nine degrees when measured from a vertical plane that is co-planar with the interior lip of the of the front border of the body.

17. A method comprising:

disposing a panel within a cavity defined by at least one interior surface of a body of a frame, wherein a first channel is disposed on a first portion of the at least one interior surface and a second channel is disposed on a second portion of the at least one interior surface of the body, a front end of each of the first and second channels is more proximate to a front side of the body than a back end of each of the first and second channels, and the body includes a front border that defines a window, and wherein the front border includes an interior lip that protrudes inwardly toward the center of the frame from the at least one interior surface, and wherein an image is disposed on the front side of the panel and viewable through the window; and securing the panel within the frame, wherein securing the panel comprises disposing a first end of a rod in the first channel and a second end of the rod in the second channel, wherein the rod extends between the first and second channels, and advancing the rod toward the front side of the body until the rod engages a back side of the panel and exerts a force against the back side of the panel, such that the interior lip of the front border of the body of the frame exerts an opposing force against the front side of the panel.

18. The method of claim 17, wherein the image comprises a first image and a second image is disposed on a back side of the panel, and further comprising, after securing the panel within the frame:

advancing the rod toward the back end of each of the first and second channels to remove the rod from the first and second channels;

removing the panel from the cavity;

flipping over the panel; and disposing the panel within the cavity so that the back side of the panel engages the interior lip and the second image is displayed through the window.

19. The method of claim 17, wherein the panel comprises a plurality of panels, such that the rod engages and exerts a force against a back side of a rear panel of the plurality of panels and the interior lip engages and exerts a force against a front side of a front panel of the plurality of panels, and wherein each side of each panel of the plurality of panels includes a distinct image.

20. The method of claim 19, further comprising, after securing the plurality of panels within the frame:

advancing the rod toward the back end of each of the first and second channels to remove the rod from the first and second channels;

selectively removing one of the plurality of panels that is not the front panel; and disposing the removed panel within the cavity in front of the plurality of panels to display the selected image.

* * * * *